US005228288A

United States Patent [19]

Sollami

[11] Patent Number: 5,228,288

[45] Date of Patent: Jul. 20, 1993

[54] CONTROL SYSTEM FOR HYDRAULIC ROTARY DEVICE

[76] Inventor: Phillip A. Sollami, 1300 E. Pine, Herrin, Ill. 62948

[21] Appl. No.: 870,475

[22] Filed: Apr. 17, 1992

[51] Int. Cl.[5] ..... F16D 31/00; F16D 35/00

[52] U.S. Cl. ..... 60/368; 60/468; 417/310

[58] Field of Search ..... 60/368, 458, 464, 468, 60/435, 487; 91/1; 92/125; 417/310, 307, 282; 188/306

[56] References Cited

U.S. PATENT DOCUMENTS 3,190,074 6/1965 Johns ..... 60/487
4,496,288 1/1985 Nakamura et al. ..... 417/310 X
4,597,718 7/1986 Nakado et al. ..... 417/310 X
4,859,154 8/1989 Alhara et al. ..... 417/310 X
4,892,466 1/1990 Taguchi et al. ..... 417/310 X
4,929,159 5/1990 Hayase et al. ..... 417/310 X
4,941,554 7/1990 Sollami ..... 92/125 X
5,056,990 10/1991 Nakajima ..... 417/310 X

*Primary Examiner*—Edward K. Look
*Assistant Examiner*—Hoang Nguyen
*Attorney, Agent, or Firm*—Edmond T. Patnaude

[57] ABSTRACT

An hydraulic rotary device includes a rotor which is oscillatable in a cylindrical chamber to force hydraulic fluid through a bypass conduit from one side to the other of a stator mounted in the chamber. An adjustable fluid flow restrictor is mounted in the bypass conduit and is controlled by a computer to which signals representative of the pressures on either side of the rotor and the angular position of the rotor are applied to enable adjustment and control of the speed of the rotor and/or the force required to rotate the rotor in the chamber.

7 Claims, 4 Drawing Sheets

CONTROL SYSTEM FOR HYDRAULIC ROTARY DEVICE

The present invention relates in general to hydraulic rotary devices, and it relates in particular to a new and improved system which in one aspect provides precise control of the torque required to rotate the rotor of a hydraulic rotary device used to provide torque resistance, and in another aspect enables the use of a hydraulic rotary actuator as a variable speed drive.

BACKGROUND

One type of hydraulic rotary device used to provide torque resistance device is disclosed in U.S. Pat. No. 4,941,554. It includes a rotor and a stator disposed in a hermetically sealed cylindrical chamber. The cylindrical chamber, which is normally filled with hydraulic fluid, is divided into two pressure chambers by the rotor and the stator. The two pressure chambers are interconnected externally of the housing by a bypass conduit which carries hydraulic fluid from one pressure chamber to the other as the rotor is rotated. A manually adjustable flow restrictor is located in the bypass conduit, and the setting of the restrictor determines the force required to move the hydraulic liquid from one side of the stator to the other and, consequently, the torque required to rotate the rotor.

It would be desirable to permit a computer or other device to control the setting of the restrictor so as, for example, automatically to adjust the torque required to rotate the rotor in response to the energy being expended to rotate the rotor. Such a device would be especially desirable in an exercise machine to permit the presetting of an exercise regimen, and to permit automatic adjustment of the regimen in response to the work being done by the person doing an exercise.

It would also be desirable to control the speed of a rotary actuator by controlling the flow resistance of a flow restrictor connected in a bypass conduit between the pressure chambers in a rotary actuator. In this manner a computer can be used to control the setting of the flow restrictor and could be programmed to vary the speed and range of movement of the oscillating output shaft of a rotary actuator.

SUMMARY OF THE INVENTION

Briefly, there is provided in accordance with one aspect of the present invention a new and improved control system for a rotary torque resistance device. The control system includes a pressure chamber in which a rotor is rotatable to force hydraulic liquid from one side of a stator to the other through a bypass conduit. The control system further includes a computer or other logic circuitry which processes signals from pressure sensors located in the pressure chambers of the torque resistance device and from a sensor connected to the shaft of the rotor of the device. The computer processes this data and operates a servo motor adjustably to position a flow restrictor in a hydraulic line connected between the pressure chambers on opposite sides of the stator, thereby to set the torque required to rotate the rotor in accordance with a preset program. One application for this control system is in an exercise machine where the user expends energy by rotating the rotor in the torque resistance device.

In accordance with another aspect of the invention, the rotor of a torque actuator is driven back and forth by a hydraulic pump, and a computer adjusts the resistance to the flow of hydraulic fluid from one side of the stator to the other and thus controls the speed of rotation of the rotor. As a consequence, the speed of rotation of the shaft on which the rotor is mounted can be varied and the range of arcuate movement thereof can be varied in accordance with a preset program retained in the computer.

GENERAL DESCRIPTION OF THE DRAWINGS

A better and more complete understanding of the present invention may be had from the following detailed description taken in connection with the accompanying drawings wherein.

DETAILED DESCRIPTION OF A PREFERRED EMBODIMENT

Figure 1:
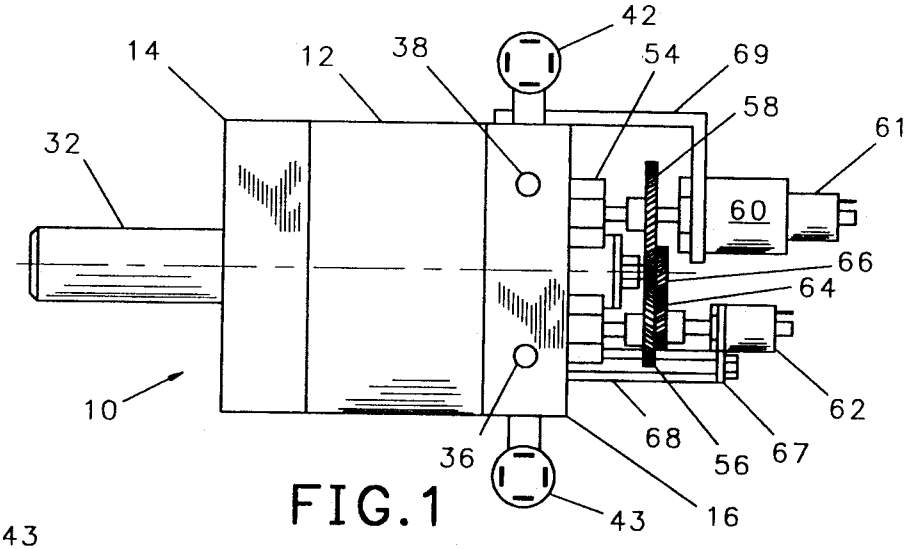
FIG. 1 is a plan view of a rotary torque actuator and associated control system.

Referring to FIGS. 1 through 4, there is shown a hydraulic rotary actuator 10 comprising a tubular, generally cylindrical housing member 12 sealably mounted between a pair of end plates 14 and 16 to enclose a cylindrical chamber. An annular elastomeric sealing ring 18 is held in an annular groove not shown in one end of the member 12 and is compressed against the inner face of the end plate 14. A similar annular elastomeric sealing ring (not visible in the drawings) is mounted to the other end of the member 12 for sealing engagement with the end plate 16. A plurality of bolts 20 extend between the end plates 14 and 16 outside of the housing member 12 to maintain the device 10 assembled.

A stator 22 is fixedly mounted between the end plates 14 and 16 within the cylindrical opening in the member 12 by means of a plurality of dowel pins 24, and the stator 22 is sealed to the inner wall of the housing member 12 and to the end plates 14 and 16 by an annular elastomeric sealing member 26 mounted in a peripheral groove in the other end of the housing member 12.

A rotor 28 in the form of a radially extending vane 30 and a shaft 32 to which the vane is affixed is journalled in the end plates 14 and 16 and sealed thereto by suitable elastomeric gaskets in a conventional manner. An elastomeric sealing gasket 34 is fitted in a groove in the peripheral edges of the vane 30 and seals the distal end and the sides of the vane 30 to the inner wall of the housing 12 and to the inner faces of the end plates 14 and 16. It may thus be seen that two sealed chambers, which are labeled A and B in the drawing, are provided between the opposite faces of the rotor vane 28 and the opposite sides of the stator 22.

A source of hydraulic fluid (not shown) is connected to the ports 36 and 38 so that hydraulic fluid may flow under pressure into and out of the chambers A and B under the control of a hydraulic pump 39 which is connected through a flow reverser 37 to the ports 36 and 38 to drive the rotor back and forth within the housing and thus drive the shaft in the same manner. A solenoid operated valve, not shown, may be connected between the pump and the ports 36 and 38 to disconnect the pump 39 from the rotary actuator.

Figure 2:
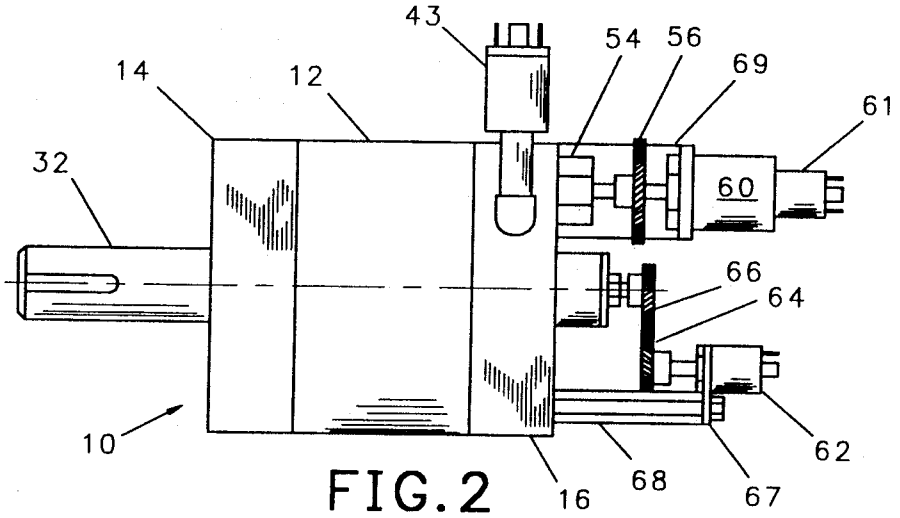
FIG. 2 is an elevational view of the actuator and control system shown in FIG. 1.
Figure 3:
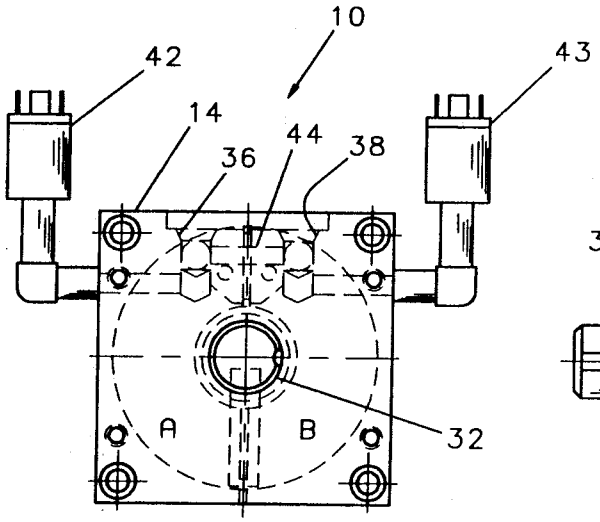
FIG. 3 is a view taken from the left hand side of FIG. 2.
Figure 4:
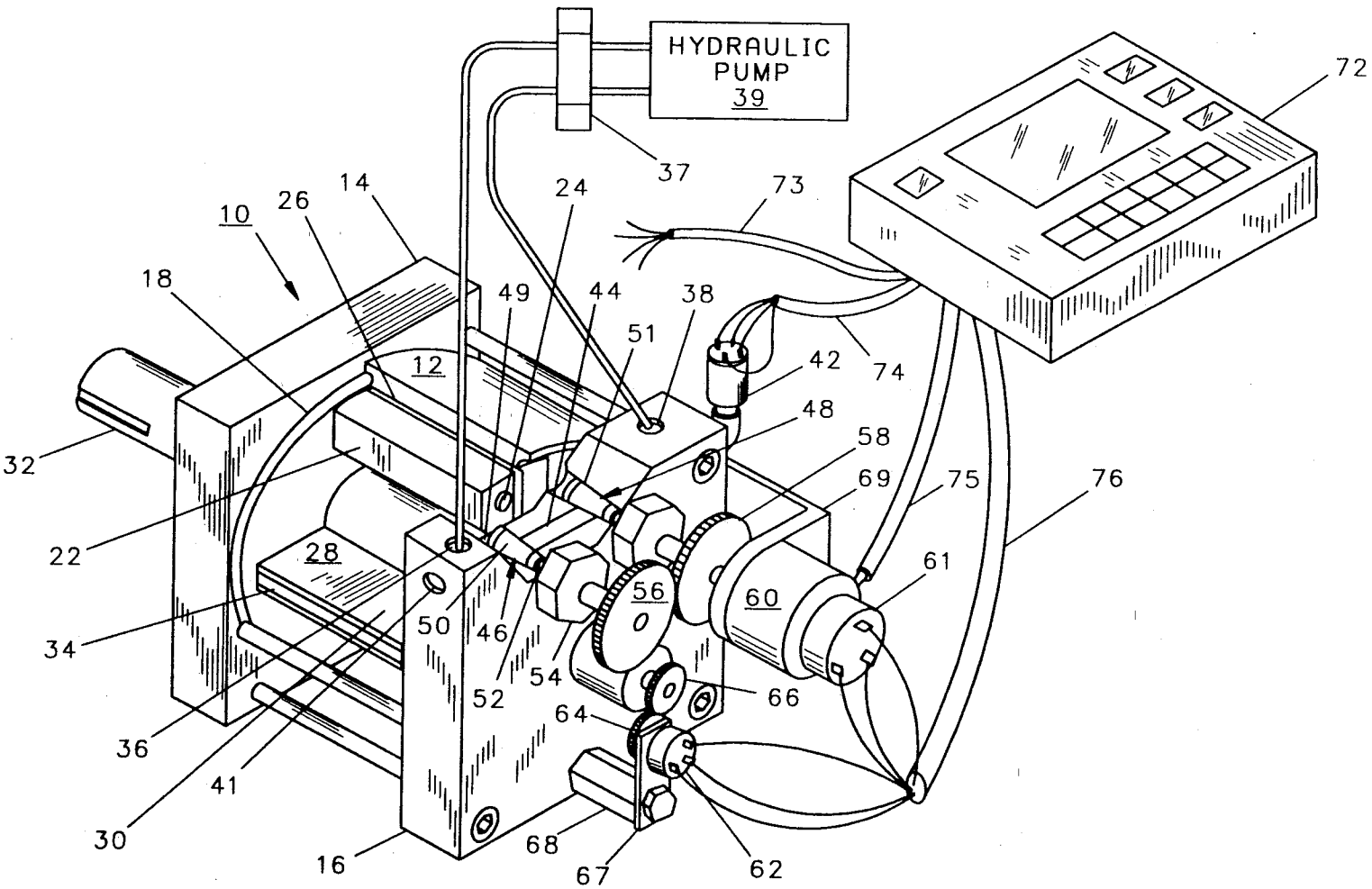
FIG. 4 is an isometric view, partly broken away, of the rotary torque actuator and associated control system shown in FIG. 1.
Figure 7:
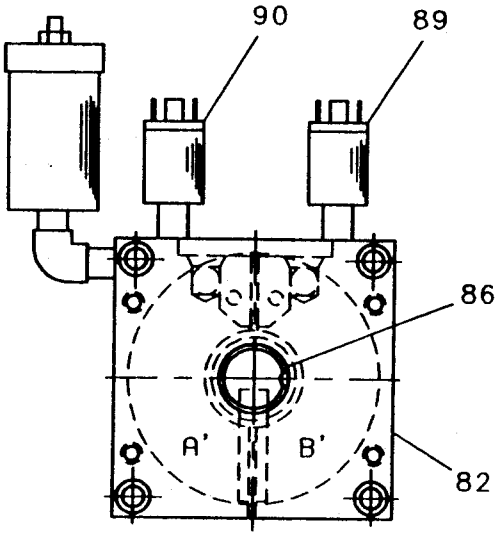
FIG. 7 is a view taken from the right hand end of FIG. 5.
Figure 5:
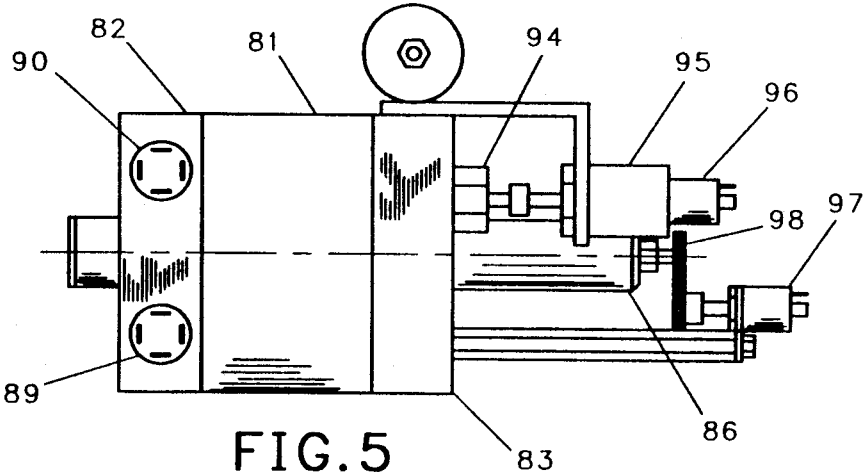
FIG. 5 is a plan view of a rotary torque resistance device and an associated control system.
Figure 6:
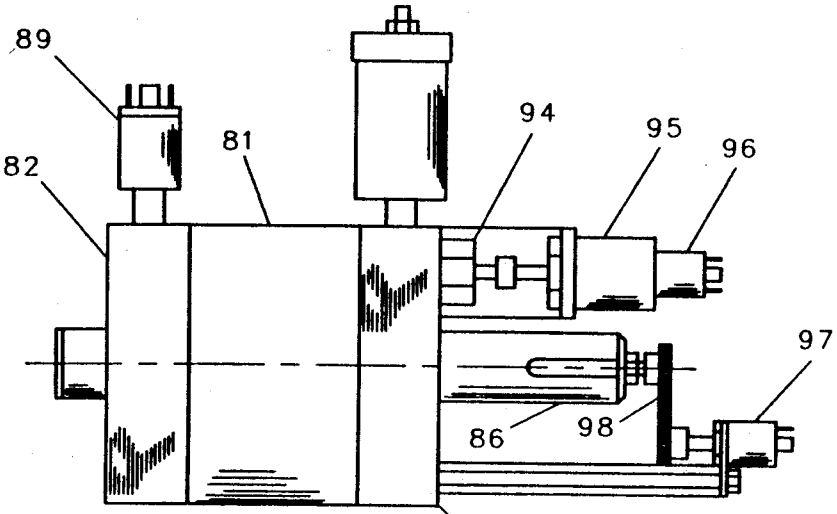
FIG. 6 is an elevational view of the rotary torque resistance device and control system shown in FIG. 5.
Figure 8:
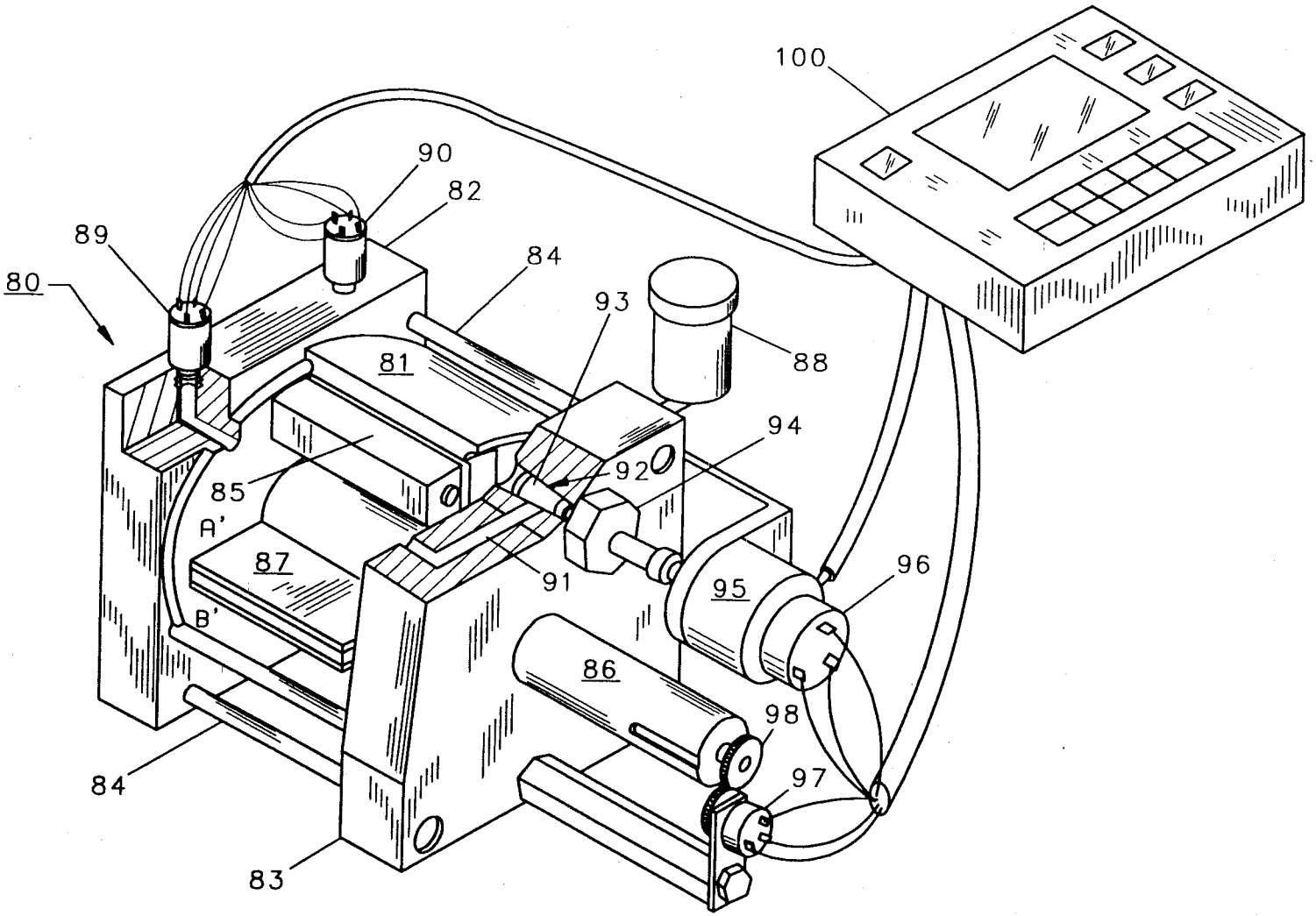
FIG. 8 is an isometric view, partly broken away, of the torque actuator and associated control system shown in FIG. 5.

The passageways 44 which connect the ports 36 and 38 to the chambers A and B also connect to a pair of transducer ports 41 in the edges of the end plate 16 in proximity to the ports 36 and 38. In FIGS. 1, 2, and 4, a pressure transducer 42 is shown connected to the rearward transducer port which connects to the chamber A, and in FIGS. 2–4 a second pressure transducer 43 is shown connected to the port 41 which connects to the chamber B. The pressure transducers 42 and 43 are conventional and produce electric output signals which corresponds to the pressure in the associated chambers. The restrictors are identical in construction and each includes a frustoconical member 50 which is axially movable in a a passageway through the restrictor which is complementary thereto so that as the member 50 is axially moved, the cross-sectional area between the chambers A and B changes thereby to controlably change the resistance to flow between the chambers A and B.

The members 50 include an axial stem 52 which has an externally threaded intermediate section which is threadedly received in a nut 54 which is affixed to the outer face of the end plate 16 so that rotation of the member 50 causes it to move axially in the passageways 46, 48 and thus change the flow resistance of the flow restrictor. Mounted on the outer end portions of the stems of the members 50 are a pair of meshed spur gears 56 and 58. A conventional servo motor 60 has its shaft coupled to the stem 52 of the flow restrictor member 50 and the gear 58 thereby to simultaneously rotate the stems of the two flow restrictors and thereby adjust the flow resistance between the chambers A and B.

The angular position of the servo motor is sensed by a first potentiometer 61 which produces an electric signal representative of the angular position of the servo motor and consequently the operative positions of the flow restrictors.

A second potentiometer 62 is coupled by a pair of intermeshed spur gears 64 and 66 to the shaft 32 thereby to provide an electric output signal representative of the angular position of the shaft 32. As shown, the gear 66 is mounted directly on the shaft 32, and the gear 64 and the potentiometer 62 are mounted on a bracket 67 fixedly mounted by a standoff 68 to the end plate 16. The potentiometer 61 is mounted to the end plate 16 by means of a bracket 69.

A digital control package 72 includes a computer or other logic circuit board, a digital display, and a keyboard for entering data into the computer and for controlling the operation thereof. Electric cables 73, 74, 75, and 76 connect the pressure transducers 42 and 43, the potentiometers 61 and 62, and the servo motor 60 to the computer in the control package 72.

In operation, the speed of rotation of the shaft 32 can be set by the computer which then controls the operation of the servo motor 60 in response to the preset program and the variable input signals from the pressure transducers and the potentiometers to drive the servo motor and thus control the speed and the extent of angular movement of the shaft 32. In this way a wide range of movements of the shaft can be provided. For example, the speed of rotation in one direction can differ from the speed of rotation in the opposite direction, the limits in the range of movement can be varied, and these movements can be made responsive to time.

Referring now to FIGS. 5, 6, 7, 8, and 9, there is shown another embodiment of the invention which is particularly suited for use in an exercise machine wherein a person exerts a force to rotate the rotor of a rotary torque resistance device 80. The device 80 includes a tubular housing 81 which is sealably mounted between a pair of end plates 82 and 83 which are held in assembled relationship with the housing by means of a plurality of bolts 84. A stator 85 is fixedly mounted between the end plates 82 and 83 within the housing 81. A rotor which includes a shaft 86 and a radially extending vane 87 affixed thereto is rotatable within the housing and divides the chamber within the housing into two pressure chambers designated A′ and B′ in the drawings. It will be seen that the device 80 is similar in construction to the device 10 described herein in connection with FIGS. 1–4, the housings, stators and rotors being identical. A reservoir 88 holds a supply of hydraulic fluid which replaces any hydraulic fluid which may leak from the reservoir, and acts as an accumulator chamber when the volume of hydraulic fluid inceases as a result of an increase in temperature thereof.

A pair of pressure transducers 89 and 90 are mounted in ports respectively provided in the end plate 82 and which are respectively connected to pressure chambers A′ and B′ on opposite sides of the rotor vane 87. A bypass passageway 91 is provided in the end plate 83 and opens at its ends into the chambers A′ and B′ so that as the rotor is rotated within the housing hydraulic fluid contained in the chambers A′ B′ and in the bypass passageway 91 flows back and forth in the bypass passageway 91 between the chambers A′ and B′.

In order to vary the torque required to rotate the rotor, a flow restrictor 92 is located in the passageway 91. It is preferably identical to the flow restrictors shown in FIG. 1 and includes a frustoconical intermediate section 93 which is moved in an axial direction to change the cross sectional area between the section 93 and a frustoconical complementary section of the passageway 91. An intermediate portion of the stem is threadedly received in a nut 94 which is fixed against rotation to the end plate 83 and a servo motor 95 has its shaft coupled to the stem portion of the flow restrictor 92 to rotate the stem and thus cause the flow restrictor to move axially in the passageway 91 to adjust the resistance to flow between the chambers A′ and B′ and thus the torque required to rotate the rotor.

A potentiometer 96 is mounted to the shaft of the servo motor 95 and a second potentiometer 97 is coupled by a gear train 98 to the shaft 86 of the rotor to provide an electric output signal representative to the angular position of the shaft 86. The electric terminals of the pressure transducers 89 and 90 and of the potentiometers 96 and 97 are connected to a digital control package 100 including a computer, a digital display, and a keyboard for entering data into the computer and for controlling the operation of the computer.

In operation, an exercise program or regimen can be stored in the computer memory which then controls the torque required to rotate the rotor in relation to any one of a number of variables. For example, the torque can be increased or decreased in proportion to the angular position of the shaft, to the number of times the shaft has been rotated during an exercise, the speed of rotation of the shaft, and to the direction of rotation of the shaft as well as in proportion to other variables measured by the transducers and the potentiometers.

While the present invention has been described in connection with particular embodiments thereof, it will be understood that those skilled in the art may make many changes and modifications thereto without departing from the true spirit and scope of the invention. Therefore, it is intended by the appended claims to cover all such changes and modifications which come within the true spirit and scope of the present invention.

What is claimed:

1. An hydraulic rotary device, comprising in combination a housing enclosing a generally cylindrical chamber, a stator disposed in said housing, a rotor rotatable in said housing between opposite sides of said stator, said rotor dividing said chamber into a first chamber and a second chamber;

a bypass conduit connected between opposite sides of said stator and between said first chamber and said second chamber, an adjustable fluid flow restrictor in said bypass conduit, a computer for producing an output signal for controlling said fluid flow restrictor to adjust the fluid flow through said bypass conduit, transducer means for producing signals representative of the pressures in said housing on opposite sides of said stator, means connecting said transducer means to input said signals representative of the pressures in said housing into said computer, means for producing a signal representative of the angular position of said rotor in said housing, and means connecting said means for producing a signal representative of the angular position of said rotor for input of said signal representative of said angular position of said rotor into said computer, said output signal of said computer being related to the values of said signal representative of said pressures in said housing and said signal representative of said annular position of said rotor.

2. The combination according to claim 1, wherein said means for producing a signal representative of the angular position of said rotor is a potentiometer.

3. The combination according to claim 2, comprising hydraulic pump means for pumping hydraulic fluid from one side of said stator to the other to drive said rotor.

4. The combination according to claim 3, wherein said fluid flow restrictor means comprises first and second longitudinally movable flow restrictor members, intermeshed gears respectively connected to said flow restrictor members for simultaneous operation thereof.

5. The combination according to claim 4, wherein said flow restrictor members each have a frustoconical surface longitudinally movable relative to a fixed complementary surface to adjust the annular space between said surfaces.

6. The combination according to claim 5, wherein said flow restrictor members each have a threaded section threadedly received in a threaded section of said housing.

7. The combination according to claims 3, comprising flow reverser means connected between said pump and said housing for reversing the flow of fluid to the sides of said stator in said housing.

* * * * *